US007270497B2

(12) United States Patent
Von Langsdorff

(10) Patent No.: US 7,270,497 B2
(45) Date of Patent: Sep. 18, 2007

(54) PAVING ELEMENT

(75) Inventor: Harald Von Langsdorff, Ontario (CA)

(73) Assignee: F. von Langsdorff Licensing Limited, Inglewood (CA)

( * ) Notice: Subject to any disclaimer, the term of this patent is extended or adjusted under 35 U.S.C. 154(b) by 0 days.

(21) Appl. No.: 11/116,272

(22) Filed: Apr. 28, 2005

(65) Prior Publication Data

US 2005/0193679 A1 Sep. 8, 2005

Related U.S. Application Data

(63) Continuation of application No. PCT/CA03/01653, filed on Oct. 24, 2003.

(60) Provisional application No. 60/421,580, filed on Oct. 28, 2002.

(51) Int. Cl.
*E01C 5/00* (2006.01)
*E01C 11/00* (2006.01)

(52) U.S. Cl. ..... 404/39; 404/29; 404/34; 404/36; 404/41; 52/590.2; 52/591.4; 52/604; 52/609

(58) Field of Classification Search ..... 52/591.4, 52/609, 591.1, 572, 604, 177, 392, 590.2; 404/41, 34, 29, 36, 39; D25/113
See application file for complete search history.

(56) References Cited

U.S. PATENT DOCUMENTS

| | | | | | |
|---|---|---|---|---|---|
| 106,651 | A | * | 8/1870 | Beidler | 404/41 |
| 457,982 | A | * | 8/1891 | Bohme | 52/574 |
| 511,497 | A | * | 12/1893 | Blaine | 404/41 |
| 652,995 | A | * | 7/1900 | Calkins | 52/591.5 |
| 726,506 | A | * | 4/1903 | Capen | 52/591.4 |
| 884,498 | A | * | 4/1908 | King | 52/89 |
| 1,244,008 | A | * | 10/1917 | Wheeler | 404/41 |
| RE14,904 | E | * | 6/1920 | Wheeler | 404/41 |
| 1,417,010 | A | * | 5/1922 | Wright et al. | 404/41 |
| 1,812,711 | A | * | 6/1931 | Pessione | 404/42 |
| 2,319,065 | A | * | 5/1943 | Karmanocky | 52/89 |
| 2,605,681 | A | * | 8/1952 | Trief | 404/41 |
| 3,025,641 | A | * | 3/1962 | Ahtiainen | 52/415 |

(Continued)

FOREIGN PATENT DOCUMENTS

DE 830 806 C 2/1952

(Continued)

OTHER PUBLICATIONS

Derwent-acc-No 1991-252945, Abstracted-Pub-No: AU 9168594A, Jul. 1991, 4 pages.*

*Primary Examiner*—Robert Canfield
(74) *Attorney, Agent, or Firm*—John R. S. Orange; Brett Slaney; Blake, Cassels & Graydon LLP

(57) ABSTRACT

A cluster of paving elements is formed with a peripheral edge having a re-entrant formation formed between the upper supporting surface and the lower, supported surface. The formation engages a complimentary formation on an adjacent cluster to inhibit relative movement between the clusters. The re-entrant formation may be applied to individual paving elements in the cluster or to the exposed faces of the elements at the periphery of the cluster. The elements in the cluster may be shaped to inter-engage to inhibit relative movement between the elements with in the cluster.

5 Claims, 6 Drawing Sheets

U.S. PATENT DOCUMENTS

| | | | | | |
|---|---|---|---|---|---|
| 3,221,614 | A | * | 12/1965 | Pertien | 404/41 |
| 3,602,111 | A | * | 8/1971 | Laguardia Clemente | 404/41 |
| 3,859,000 | A | * | 1/1975 | Webster | 404/41 |
| 4,016,692 | A | | 4/1977 | Jordan et al. | |
| 4,963,055 | A | * | 10/1990 | Sims, Jr. | 404/41 |
| 5,046,887 | A | | 9/1991 | Fontana et al. | |
| 5,098,218 | A | * | 3/1992 | Reese et al. | 404/35 |
| D326,531 | S | * | 5/1992 | Lewis | D25/113 |
| 5,496,129 | A | | 3/1996 | Dube | |
| D409,312 | S | * | 5/1999 | Staten et al. | D25/113 |
| D479,342 | S | * | 9/2003 | Dawson | D25/113 |
| 6,863,469 | B2 | * | 3/2005 | Bolduc et al. | 404/41 |
| 2002/0025357 | A1 | | 2/2002 | Spangenberg et al. | |
| 2005/0193679 | A1 | * | 9/2005 | Langsdorff | 52/605 |

FOREIGN PATENT DOCUMENTS

| | | | | |
|---|---|---|---|---|
| DE | 199 37 639 | A | 2/2000 | |
| DE | 298 24 681 | U | 3/2002 | |
| EP | 187294 | A2 * | 7/1986 | |
| FR | 16160 | * | 2/1898 | 52/591.4 |
| WO | 2004-038104 | A1 * | 5/2004 | |

* cited by examiner

PAVING ELEMENT

This application is a continuation of PCT/CA2003/001653 filed on Oct. 24, 2003 and claims priority from U.S. Provisional Application No. 60/421,580 filed on Oct. 28, 2002.

FIELD OF THE INVENTION

The present invention relates to methods of paving, paving elements and apparatus for making such elements.

BACKGROUND OF THE INVENTION

It is well known to provide a hard wearing surface by applying a pavement to it. The pavement may be formed from a wide variety of materials such as asphalt or concrete but a particularly attractive solution to providing a paved area is the use of paving elements. These elements are laid side-by-side to cover the required area and may be of different shapes or colours to provide an aesthetically pleasing finished surface. The elements are formed as individual units of relatively small size and may be formed with shapes that interlock with one another to inhibit relative movement once laid. Typically, the paving elements will be made from a concrete moulded to the desired shape and finish.

It is usual to manufacture the paving elements as clusters that can be formed in a single mould. The clusters can then be stacked on a palette or other transport device, one layer upon another and transported to the site for installation. With some arrangements, mechanical devices are used to transfer clusters from the palette and lay them directly upon the surface to be paved. The next cluster is then laid side-by-side and rapid installation of the paving is accomplished.

One problem found with the manufactured installation of clusters is that the periphery of the cluster is delimited by a common joint line. That common joint line may allow relative movement between the adjacent clusters even though the individual elements in the cluster are inhibited from relative movement.

One solution to the above problem has been to provide a specially shaped cornerstone for each cluster that attempts to lock the two clusters to one another. However, this arrangement is difficult to install and mould and complicates the stacking of clusters one above the other.

Even though the stones within each cluster are formed with interlocking configurations, it is frequently possible for stones to move relative to one another along a pair of mutually perpendicular axes. Such relative movement may occur en masse to give a diagonal shift within the cluster of stones.

Some configurations of stone provide indents that inhibits movement along one of the axes but still permits separation along the other axis, thereby again permitting a separation between two parts of the cluster. In practice, it is found that even highly complex shapes permit a degree of separation or sliding along particular axes when arranged in a repeating pattern in a cluster.

One solution that has been proposed is to interlock each stone with a through recess and a corresponding projection that extends between the upper and lower faces of the element. Typically, the projection is formed as a dovetail. However, such an arrangement is relatively difficult to manufacture and introduces a line of weakness at the pin of the dovetail on the block. It has also been proposed to use a key element between the stones but then the keys are visible.

It is therefore an object of the present invention to obviate or mitigate the above disadvantages.

SUMMARY OF THE INVENTION

In general terms, one aspect of the present invention provides paving elements having a supported surface, a supporting surface, and peripheral faces extending between the surfaces. At least one of the peripheral faces has a re-entrant formation formed between the two surfaces to provide an abutment surface facing the interior of the paving element.

In one embodiment, the abutment surfaces are oppositely directed on opposed side faces. In a further embodiment, the peripheral face depending from the supporting surface overhangs the peripheral face projecting from the supported surface.

In a further aspect, a cluster of paving elements is delimited by a peripheral edge. Elements within the cluster abut along common faces and the peripheral edge is formed as a re-entrant formation to provide vertically extending abutment faces facing the interior of the cluster.

BRIEF DESCRIPTION OF THE DRAWINGS

Embodiments of the invention will now be described by way of example only with reference to the accompanying drawings in which.

DESCRIPTION OF THE PREFERRED EMBODIMENTS

Figure 1:
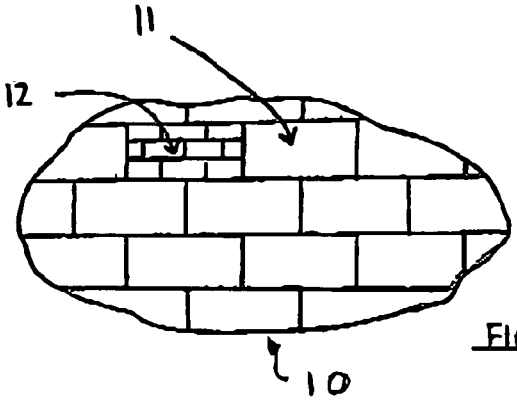
FIG. 1 is a plan view of a paved area.

Referring therefore to FIG. 1, a pavement generally indicated 10 is formed from clusters indicated at 11 of individual paving elements 12 arranged in seriatim to cover the required area. It will be appreciated that the paving elements 12 may be one of a number of different shapes and abut one another along common faces to provide a continuous surface. The clusters 11 are generally rectangular in overall shape to allow stacking and placement but the elements 12 within the cluster 11 are typically of other shapes that may be arranged in a repeating pattern to form a generally rectangular cluster 11. Although, in commercial applications, clusters of elements are more common, embodiments applied to an individual elements will first be described and further embodiments applied to clusters are described subsequently.

Figure 2:
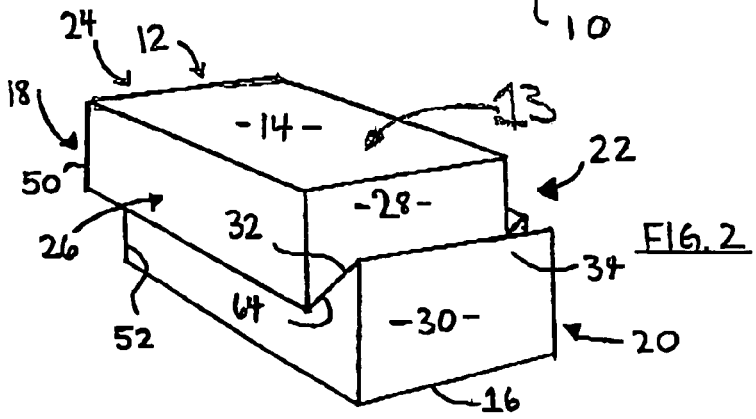
FIG. 2 is a perspective view of a paving element used on the paved area of FIG. 1.

One form of paving element is shown in FIG. 2.

The paving element 12 has a body 13 with an upper surface 14 and an oppositely directed lower surface 16. The lower surface 16 is supported on the ground to be covered and the upper surface 14 provides the supporting surface for passage across the pavement. For convenience the term upper surface and lower surface will be used in the description, it being understood that this relates to the orientation of the paving element when normally installed.

The upper and lower surfaces 14, 16 are interconnected by a peripheral face generally indicated 18. The peripheral face 18 is formed from side faces 20, 22, 24, 26. The side face 20 is sub-divided into upper and lower facets 28, 30 that are offset from one another in a vertical plane. An inclined abutment face 32 extends from the upper edge 34 of the facet 30 to the lower edge 36 of the facet 28. The offsetting of the facets 28, 30 and the abutment face 32 provides a re-entrant formation on the side face 20 with the face 32 directed toward the interior of the body 13 of the paving element 12. The side face 22 is similarly formed with offset facets 40, 42 with the abutment face 44.

The side face 24 has the upper and lower facets 50, 52 similarly offset but with the upper facet 50 overhanging the lower facet 52. An abutment face 54 is provided between the two facets and is downwardly directed. The side face 26 is similar to the side face 24 with offset facets 60, 62 and a re-entrant abutment face 64.

Figure 3:
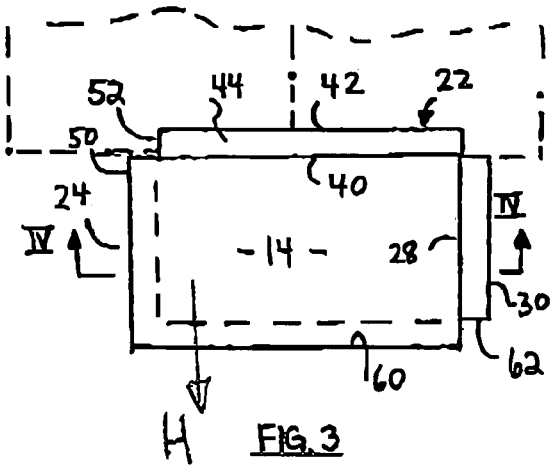
FIG. 3 is a plan view of the paving element shown in FIG. 2.
Figure 4:
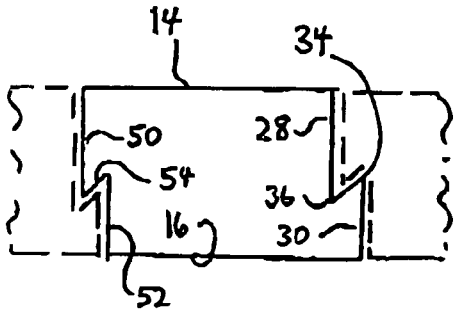
FIG. 4 is a section on the line IV-IV of FIG. 3.

The paving element 12 therefore has oppositely directed faces with complimentary re-entrant formations. As can be seen in FIGS. 3 and 4, this permits the paving elements 12 to be placed side-by-side with the abutment faces 54,64 overlapping in a vertical direction. The overlapping abutment faces 54,64 inhibits relative movement of adjacent paving elements and thereby prevents separation in a horizontal plane of the cluster indicated by arrow H in FIG. 3. It will also be noted that the periphery of the upper surface 14 defines an uninterrupted shape of the paving element and the formations provided on the peripheral edge 18 do not interfere with the aesthetic appearance of the upper face 14. As shown in FIG. 4, the re-entrant formation is located at approximately the mid-point of the side face. It will be appreciated that the formation may be located above or, preferably, below the mid-point.

Figure 5:
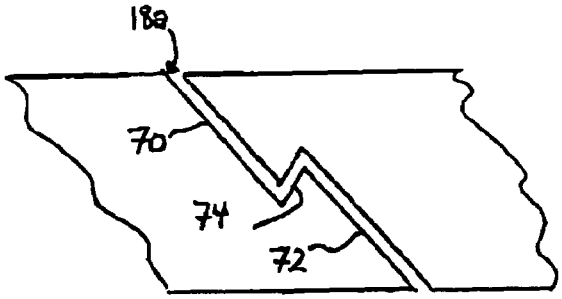
FIG. 5 is a view similar to FIG. 4 of an alternative embodiment of the paving element of FIG. 2.

Referring to FIG. 5, an alternative arrangement of paving element 12*a* has an inclined peripheral face 18*a*, so as to generally define an inclined parallelepiped. Each of the side faces forming the peripheral face 18 is sub-divided into a pair of facets 70, 72 interconnected by an abutment face 74 to define a re-entrant formation. Complimentary shapes are provided along adjacent faces of adjacent blocks to provide an interlocking formation in a manner described above with respect to FIG. 4.

Figure 6:
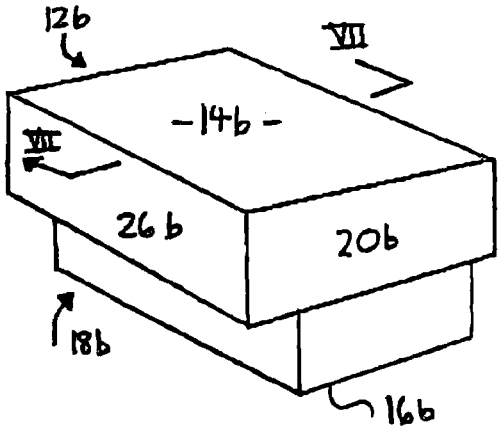
FIG. 6 is a perspective view of a further embodiment of a paving element.

An alternative arrangement is shown in FIG. 6 in which like components will be identified with like reference numerals but with a suffix b added for clarity. In the arrangement of FIG. 6, the paving element 12*b* has an upper surface 14*b* which extends beyond the periphery of the lower surface 16*b*. Peripheral face 18*b* is formed similarly on each of the side faces 20*b*, 22*b*, 24*b* and 26*b*. The side face 20*b* has upper and lower facets 28*b*, 30*b* with the facet 28*b* offset outwardly of the facet 30*b*. An inclined abutment face 32*b* extends between the facets 30*b*, 28*b* to define a re-entrant formation. Each of the side faces is formed in a similar manner and therefore will not be described in detail.

Upon abutment of the paving elements 12*b* adjacent one another, a downwardly directed chevron is formed between the elements adjacent the lower faces 16*b*. A keystone 80 is located within the cavity formed between the pair of stones and has a complimentary, shape to the cavity. Accordingly the keystone 80 has a pair of divergent inclined faces 82 that abut the abutment face 32*b* of each of the paving elements 12*b* to overlap in a vertical direction. The keystone 80 therefore inhibits separation of the elements 12*b* in a horizontal plane. Again the periphery of the upper surface 14*b* is not interrupted by the keystones. The keystone may be formed from a similar material to the paving element or may be a different material such as a plastic extrusion.

Figure 8:
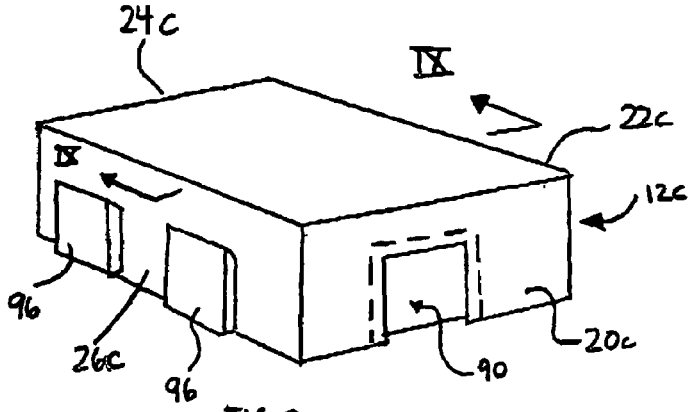
FIG. 8 is a perspective view of a still further embodiment.
Figure 9:
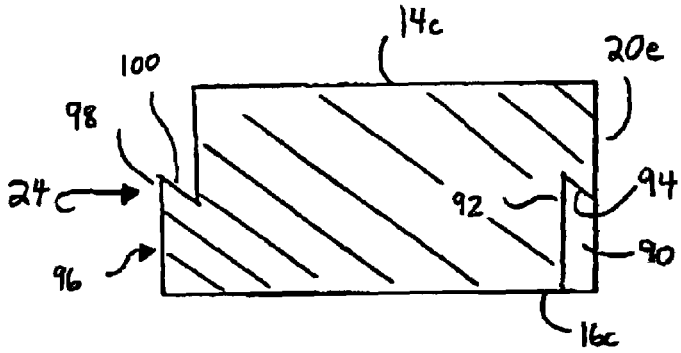
FIG. 9 is a view on the line IX-IX of FIG. 8.
Figure 10:
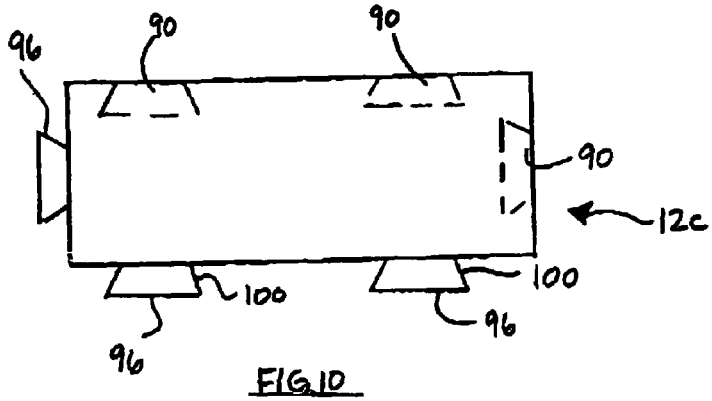
FIG. 10 is a plan view of the paving element shown in FIG. 8.

In each of the above embodiments, the re-entrant formation is shown as extending along the entire side of the paving element 12. In the embodiment shown in FIG. 8-10 the re-entrant formation is localised so as to extend along only a portion of each of the faces 20*c*, 22*c*, 24*c* and 26*c*. Referring therefore to FIG. 8, the paving element 12*c* has a peripheral face 18*c*. A recess 90 is formed in the side face 20*c* and is defined by an end wall 92 and inclined abutment faces 94. The abutment faces 94 are directed toward the interior of the element 12*c* to define the re-entrant formation.

Complimentary formations 96 project from the side face 26*c* and have an outer face 98 with inwardly inclined abutment faces 100. In the embodiment shown, two projections 96 and two recesses are formed on opposite longitudinal sides of the element 12*c* and a single recess on each of the shorter sides. It will be noted that the recesses 90 and projections 96 extend from the lower face 16*c* but terminate partially along the peripheral face 18*b*. The formations and recesses therefore do not intersect the upper face 14*c* and therefore do not interfere with the visual effect created by the upper face. The provision of the interrupted re-entrant formation not only inhibits separation of the elements from one another but also inhibits sliding of one row of elements relative to the other in a direction parallel to edges of the elements. The recesses 90 and projections 96 provide an interlocking effect in the direction of the edge to inhibit sliding.

Figure 11:
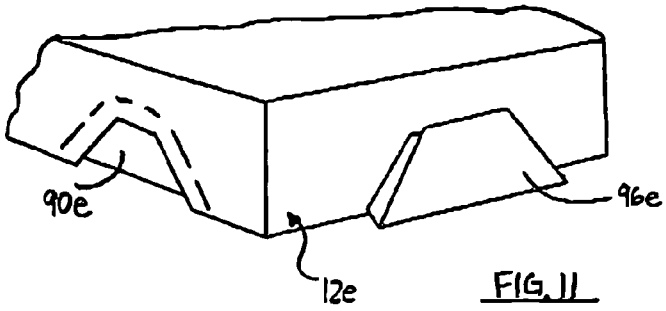
FIG. 11 is a perspective view of a corner of a still further embodiment of paving element.
Figure 12:
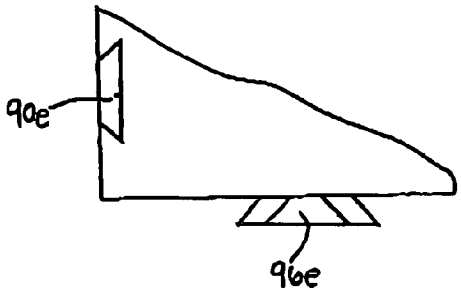
FIG. 12 is a view on the line XII-XII of FIG. 11.

An enhanced wedging effect may be obtained as shown in FIGS. 11 and 12 by forming the recesses 90 and the projections 96 with upwardly convergent edges. Thus the elements 12*e* have trapezoidal recesses 90*e* and complimentary trapezoidal projections 96*e* As the projection 96*e* enters the complimentary recess 90*e*, it is located in both the horizontal plane and a vertical plane.

It will of course be appreciated that other shapes may be utilised and that the alternative formations described above may be similarly applied to these other shapes.

Figure 13:
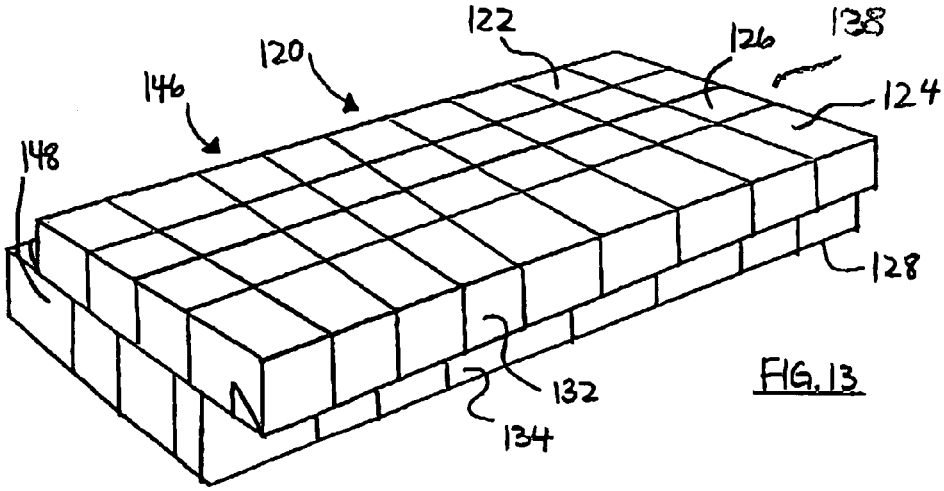
FIG. 13 is a perspective view of a cluster of paving elements.
Figure 14:
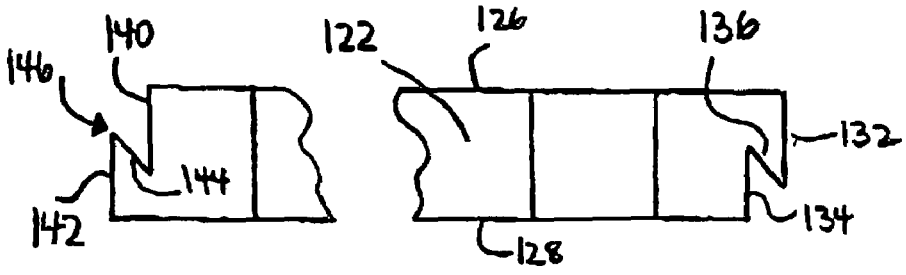
FIG. 14 is a view on the line XIV-XIV of FIG. 13.

The above description has described the formation of individual paving elements. As noted above, it is more common to utilize a cluster of elements 12 and similar benefits may be obtained by applying the re-entrant formation to the periphery of a cluster of stones which is typically used to pave larger areas. Referring therefore to FIG. 13, a cluster 120 formed from individual paving elements 122 has a peripheral edge 124 extending between upper surface 126 and lower surface 128. The paving elements within the cluster are formed with planar abutting faces and are of pre-defined shape, typically rectangular. The paving elements 122 at the periphery of the cluster 120 have the outwardly directed exposed side face formed with a re-entrant formation. As can best be seen in FIG. 14, the paving elements 122 along one of the side faces 130 of the cluster 120 has laterally offset facets 132, 134. An inclined abutment face 136 extends between the facets 132, 134 to provide a re-entrant formation along the face 136. A similar formation is formed along the adjacent edge 138 and complimentary formations having offset facets 140, 142 interconnected by inclined abutment face 144 are formed on the opposite faces 146, 148. The peripheral edges of the; clusters 120 are therefore formed with re-entrant formations and upon placement of a cluster alongside a similar cluster, the peripheral edges between the clusters will interlock and inhibit relative horizontal movement.

Figure 15:
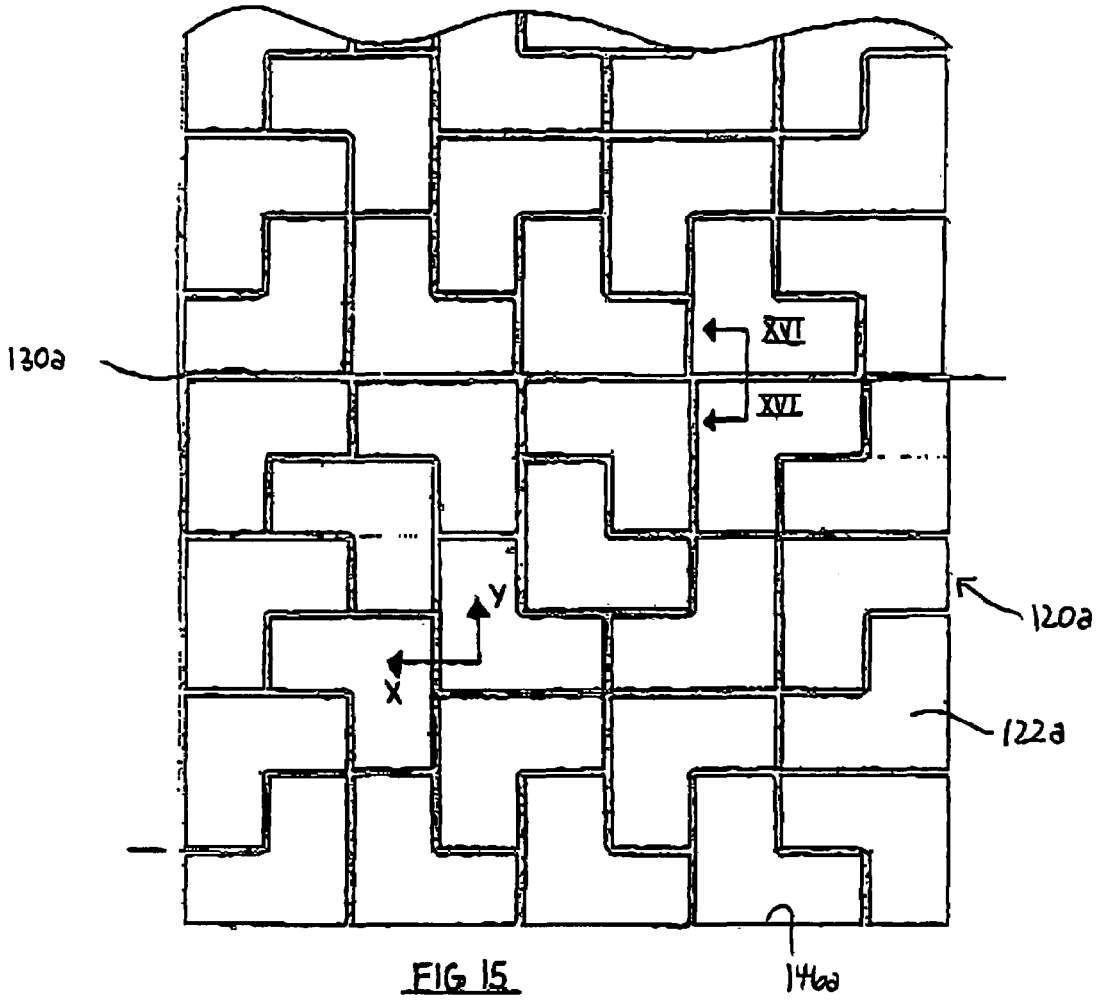
FIG. 15 is a plan of an alternative cluster of elements.
Figure 16:
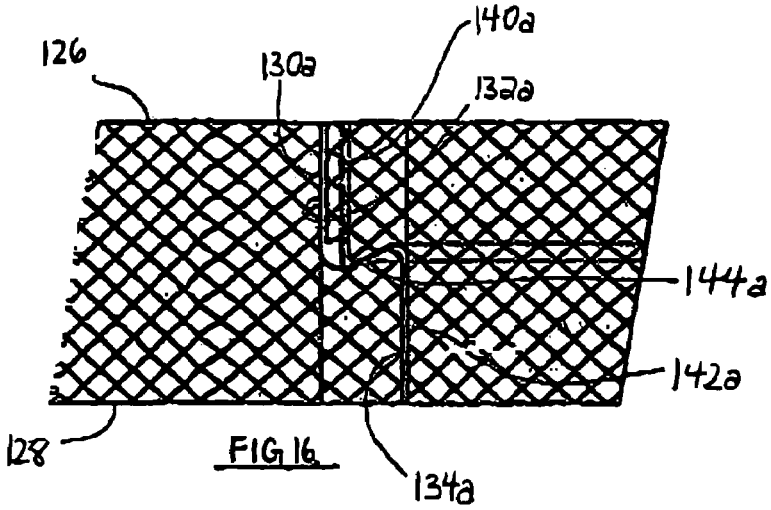
FIG. 16 is a view on the line XVI-XVI of FIG. 15.

The stones within the cluster may be configured with interlocking shapes that similarly inhibit relative movement as shown in FIGS. 15 and 16. Referring to FIG. 15, each of the elements 122*a* is formed as an L-shaped element in plan. The elements 122*a* are nested within one another so that the legs of the L's overlap. The elements 122*a* are arranged such that the periphery of the cluster 120*a* is generally rectangular. The clusters 120*a* may be placed side by side in a running bond to form a repeating pattern. The interlocking arrangement of the elements 122*a* inhibits relative longitudinal and lateral movement, as indicated by the arrows x, y, but relative bodily movement normal to the line of symmetry shown by chain dot lines is possible.

To inhibit such movement, the re-entrant formations are used on elements 122*a* at the periphery of the cluster 120 along oppositely directed side faces 130*a*, 146*a*. The faces 138*a*, 148*a* are left planar for ease of manufacture, although re-entrant formations could be incorporated if needed.

As shown in FIG. 16 the elements 122*a* along face 130*a* are thus formed with offset facets 132*a*, 134*a* and inclined facet 136*a* and the face 146*a* formed with a complimentary formation with facets 140*a*, 142*a*, and 144*a*. Upon positioning of the clusters 120*a* adjacent to one another, the formations engage to inhibit separation of the elements at the 'join' between the clusters. The separation along the line of symmetry may also be inhibited due to the combined effect of the formations and the shape of the elements.

Figure 7:
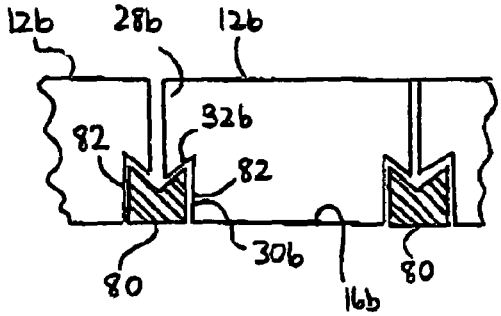
FIG. 7 is a view on the line VII-VII of FIG. 6.

The peripheral edge of the cluster 120 may be formed with similar edges as described above with respect to FIGS. 6 and 7 and key elements located adjacent the edges to provide interlocking along the join line between adjacent clusters. Similarly, the formations shown in FIGS. 8 to 12 may be used on the peripheral edges. In each case, the abutting edges of the elements within the cluster may be configured with interlocking re-entrant formations as shown or rely on interlocking configurations to attain stability.

Figure 17:
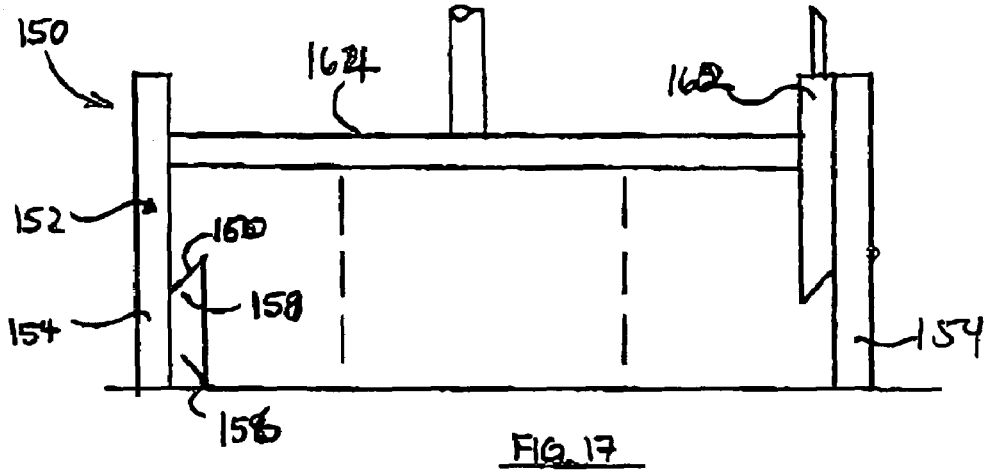
FIG. 17 is a sectional view of a mould used to form the paving element of FIG. 2.

The paving elements described above are moulded from concrete and the provision of the re-entrant formations must be accommodated in the mould utilised. Referring therefore to FIG. 17, a mould 150 has a peripheral frame 152 that may define either the entire cluster with internal partitions for the elements or the periphery of an individual paving element itself. Each of the side members 154 is of uniform cross-section. A slot 156 is provided it an end wall to receive a sword 158 that can be slid along the side wall to form a shoulder 160.

The shoulder has a shape corresponding to the shape of the re-entrant formation to be formed at the periphery of the paving element. The mould 150 is charged with a concrete mixture and a shoe 162 slid into the mould adjacent the side frame 154. The shoe 162 has a cross-section corresponding to the recess to be formed on the periphery of the element and displaces a concrete material from the side member 154. Compression shoe 164 is then placed within the mould to be a tight sliding fit between the frame of the mould and the shoe. A force is applied to the shoe to consolidate the concrete. Once the concrete has attained a stable configuration, the shoes are withdrawn and the element may be withdrawn from the mould.

Figure 18:
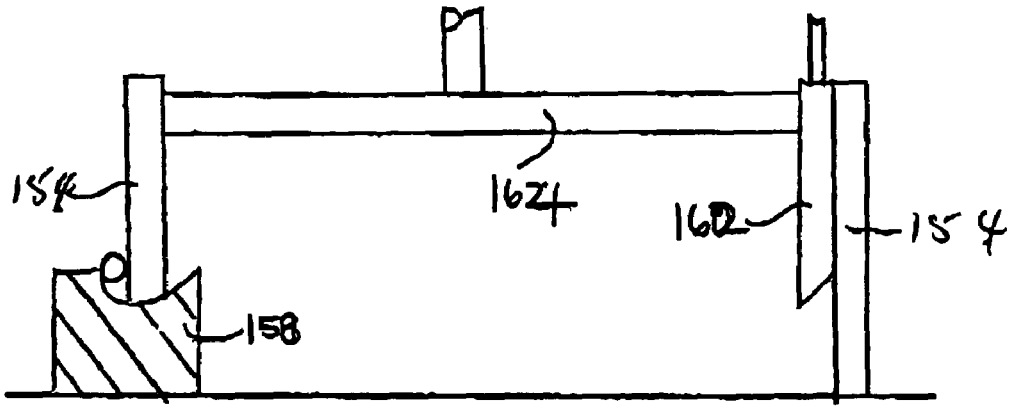
FIG. 18 is an alternative embodiment of mould.

A similar arrangement is shown in FIG. 18 where the sword 158 is hinged to the side member 154. This permits the shoulder to be swung out of the way and permit the compression shoe 164 to eject the consolidated element from the mould 150. In some configurations of clusters, such as that shown in FIG. 15, the peripheral edge of the molded cluster is indented along its length to accommodate the partitions used in the mould. In this case the shoes and shoulders are configured accordingly to produce the re-entrant formation along the respective peripheral edge when the elements are removed and the cluster consolidated.

The invention claimed is:

1. A paving cluster formed from a plurality of paving elements organized in predefined arrangement each paving element having a supporting surface, a supported surface and faces, each of which extends between said surfaces, said faces of paving elements within said cluster being planar and devoid of re-entrant formations with paving elements at the periphery of said cluster having peripheral faces extending about said cluster, said peripheral faces being defined by exposed faces of selected ones of said paving elements, at least one of said exposed faces having a re-entrant formation formed thereon between a supported surface and a supporting surface to provide an abutment surface directed to the interior of said cluster.

2. A paving cluster according to claim 1 wherein each of said exposed faces along one of said peripheral edges has a re-entrant formation formed thereon.

3. A paving cluster according to claim 1 wherein a pair of oppositely directed peripheral edges of said cluster have complementary peripheral formations formed thereon.

4. A paving cluster according to claim 1 wherein said re-entrant formation has a pair of offset facets interconnected by an inwardly directed facet.

5. A paving cluster according to claim 1 wherein said paving elements are shaped to inter-engage and inhibit relative movement between adjacent paving elements in said cluster in the plane of the cluster.

* * * * *